US005518013A

United States Patent [19]

Mansur

[11] Patent Number: 5,518,013

[45] Date of Patent: May 21, 1996

[54] IMMERSION WASHER APPARATUS

[75] Inventor: Pierre G. Mansur, Miami, Fla.

[73] Assignee: Mansur Industries Inc., Miami, Fla.

[21] Appl. No.: 364,800

[22] Filed: Dec. 27, 1994

[51] Int. Cl.[6] ..... B08B 3/04; B08B 13/00

[52] U.S. Cl. ..... 134/56 R; 134/104.1; 134/108; 134/111; 134/135; 134/147; 134/164

[58] Field of Search ..... 134/56 R, 104.1, 134/107, 108, 109, 111, 135, 141, 147, 164, 165

[56] References Cited

U.S. PATENT DOCUMENTS

| | | | |
|---|---|---|---|
| 2,724,392 | 11/1955 | Cooper | 134/165 X |
| 5,186,193 | 2/1993 | Gullberg et al. | 134/135 X |
| 5,277,208 | 1/1994 | Mansur | 134/111 X |

*Primary Examiner*—Philip R. Coe
*Attorney, Agent, or Firm*—Robert M. Downey

[57] ABSTRACT

An apparatus for soaking and cleaning articles in a cleaning solution includes a primary cleaning chamber for containing a predetermined volume of the cleaning solution therein and a filter assembly including a filtration sheet pulled from a supply across a drainage trough for removing contaminants from the cleaning solution. A sensor activates movement and replacement of saturated sections of the filtration sheet upon detecting a rise of fluid level in the drainage trough. A fan forced electronic heater supplies heat to an oxidation chamber for thermal oxidation of refuse placed therein, the resulting flue gasses being directed through a heat transfer duct, wherein heat is transferred to the solution contained in the cleaning chamber; the flue gasses exiting through a flue stack. An article support assembly includes a platform for supporting the articles to be cleaned thereon, the platform being movable between a raised position and a lowered position within the cleaning chamber to facilitate immersion of the articles in the cleaning solution. The platform and articles thereon can be agitated to cause movement relative to the cleaning solution and thereby promoting more thorough cleaning.

12 Claims, 3 Drawing Sheets

FIG. 1
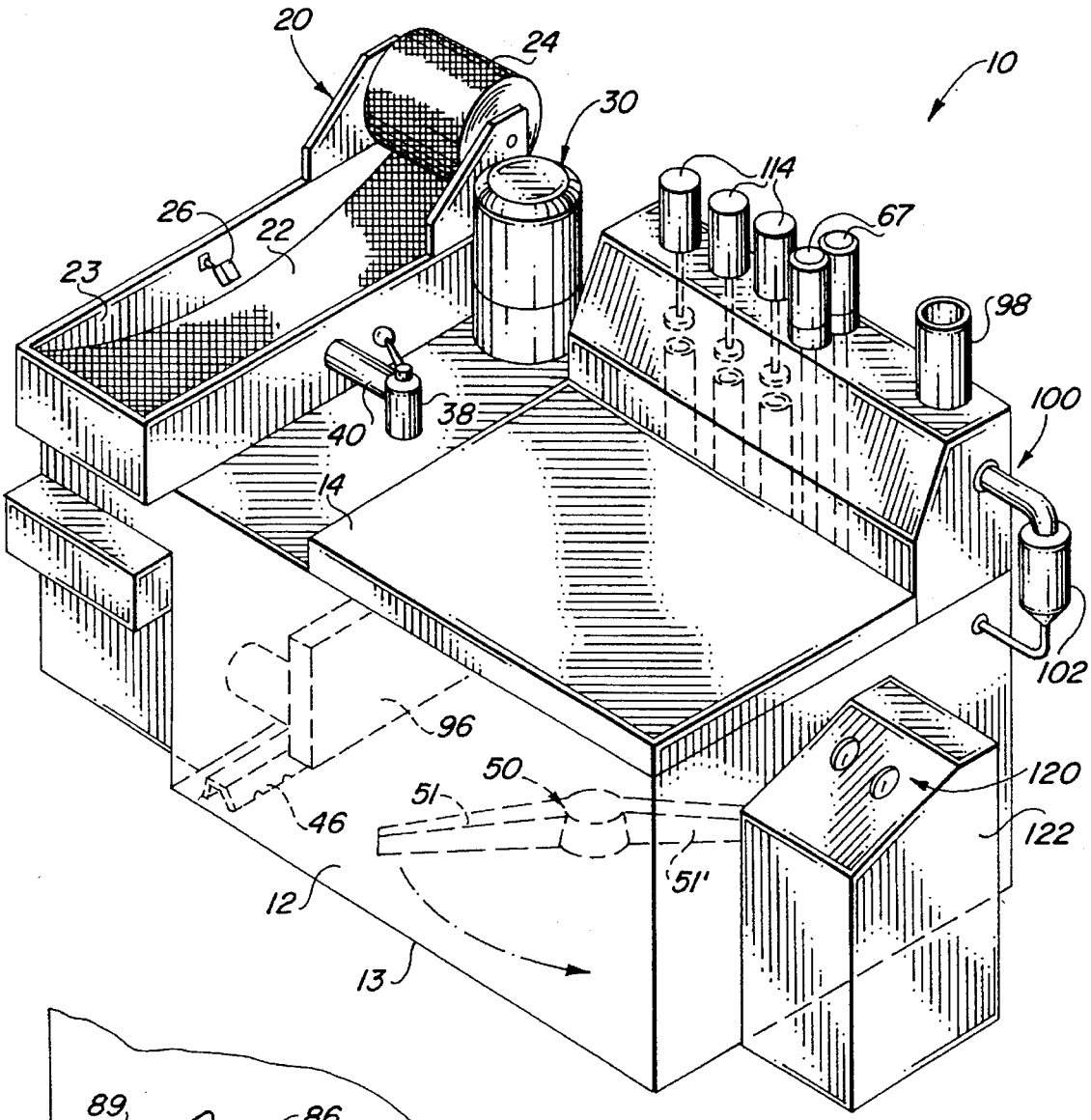
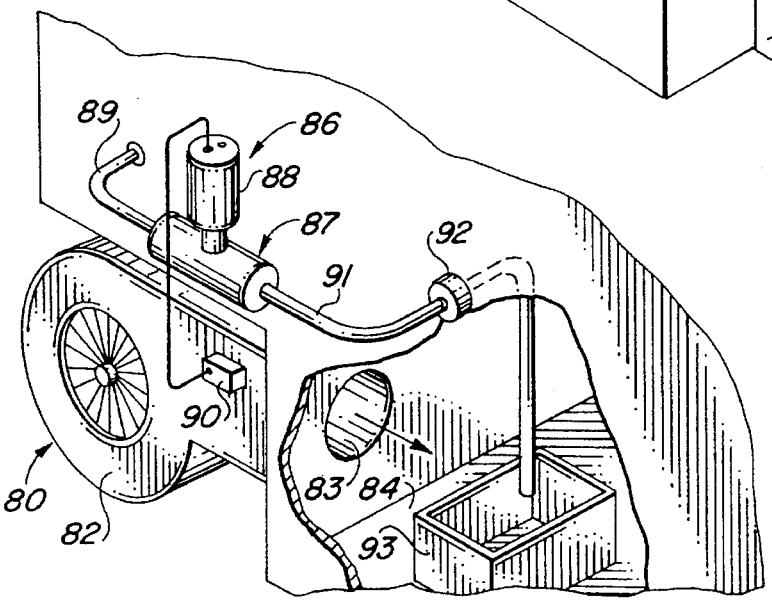
FIG. 5

IMMERSION WASHER APPARATUS

BACKGROUND OF THE INVENTION

1. Field of the Invention

This invention relates to an apparatus for soaking and cleaning articles with a cleaning solution, and more particularly, to an immersion washer apparatus having means for removing and disposing of contaminants and refuse during a recycling and solution recovery process.

2. Description of the Related Art

During maintenance, repair and rebuilding operations in virtually all industrial and commercial environments, it is necessary to wash a wide variety of parts and articles in order to remove grease, oil, dirt and other contaminants. To remove contaminants, various solvents and aqueous cleaning solutions are used in a variety of cleaning machines and assemblies. Some parts and articles are cleaned in spray washer machines of the type set forth in my previous U.S. Pat. No. 5,277,208. Still other parts, particularly smaller parts, are washed using a solvent in a sink type apparatus, of the type set forth in my previous U.S. Pat. No. 5,349,974. There are however many parts, articles and devices which need to be immersed and soaked in a cleaning solution, particularly those having blind holes and crevices which are difficult to clean. Examples of these types of articles include radiators, engine blocks and transmissions. Presently, these types of articles, comprising blind holes and crevices, are soaked in a tank containing cleaning solution for a period of time. The articles are then removed from the tank and brushed and rinsed to remove loose contaminants such as grease, oil, rust and dirt. In a short period of time, after soaking several articles, it can be appreciated that the cleaning solution becomes saturated with contaminants. Eventually, the entire charge of cleaning solution in the tank needs to be disposed of and replaced with clean solution. In a busy facility, this may need to be done one or more times a week. When changing the cleaning solution, the contaminated solution must be taken away and disposed of in a manner complying with EPA contaminant disposal guidelines. This procedure is inefficient, costly and time consuming, leaving a busy manufacturing or repair facility with no other alternative than to perform parts cleaning operations using dirty, contaminated cleaning solution for extended periods of time.

Accordingly, there is a definite need in all industries requiring parts cleaning during maintenance, manufacturing, repair and rebuilding operations, for an immersion washer apparatus having means for recycling the cleaning solution by regularly removing contaminants from the solution and disposing of contaminants and refuse on site during normal operation of the apparatus and in a manner complying with EPA disposal guidelines.

SUMMARY OF THE INVENTION

The present invention is directed to an immersion washer apparatus for washing articles such as radiators, engine blocks, transmissions and virtually any articles, particularly those having blind holes and crevices.

More particularly, the present invention includes a primary cleaning chamber for containing a predetermined charge of aqueous cleaning solution therein. During normal operations, a pump draws the cleaning solution from a bottom sweep in the cleaning chamber and delivers the cleaning solution to a drainage trough having a filtration sheet pulled thereacross. The cleaning solution is deposited on the filtration sheet and, upon passing therethrough, contaminants are removed from the solution. A sensor activates movement and replacement of saturated sections of the filtration sheet upon detecting a raise of fluid level in the drainage trough due to an inability of the solution to easily pass through the saturated filtration sheet.

An electronic or gas heater supplies heat to an oxidation chamber for thermal oxidation of refuse placed therein, including the used saturated filtration sheet sections. The hot flue gasses resulting from the thermal oxidation process are directed through a heat transfer duct which at least partially surrounds the primary cleaning chamber. Heat is transferred to the solution in the cleaning chamber as the hot flue gasses pass through the heat transfer duct and exit through a flue stack.

An article support assembly includes a platform for supporting the articles to be cleaned thereon, the platform being movable between a raised position and a lowered position within the cleaning chamber to facilitate immersion of the articles in the cleaning solution. The platform and articles thereon can be agitated to cause movement of the articles relative to the solution and thereby promoting more thorough cleaning of the articles.

Many aqueous cleaning solutions employ the use of coagulants or flocculants to gather and clump contaminants such as oils and grease into clusters which are then more easily separable from the cleaning solution. Some coagulants and flocculants act near the surface of the aqueous solution for lighter contaminants, while others act near the bottom to clump together heavier contaminants. Because coagulant and flocculant agents are generally somewhat delicate by nature, they cannot be passed through pumps, such as centrifugal pumps, because the violent turbulence will cause breakup of the charges in the agents. To address this concern, the present invention employs the use of a vacuum chamber which is specifically designed to draw both surface coagulants and flocculants as well as bottom coagulants and flocculants from the primary cleaning chamber without disturbing the charges in the various agents. From the vacuum chamber, the coagulant and/or flocculant agents are lead through a transfer conduit and deposited onto the filtration sheet in the drainage trough.

During normal operations, the cleaning solution is drawn through a sweep arm which rotates about a 360 degree movement on the extreme bottom of the cleaning chamber. In order to move contaminants which have settled on the bottom into the sweep zone of the sweep arm for pickup, the present invention further employs the use of a bottom wash system which includes a three-way valve for redirecting the discharge from the pump. Rather than the discharge being directed to the drainage trough for filtering, the three-way valve facilitates directing of the discharge of solution from the pump to bottom flush jets which wash the bottom and push bottom contaminants into the sweep zone of the bottom sweep, and thus, together with the sweep arm, achieving complete cleaning and removal of contaminants from the bottom of the cleaning chamber.

Accordingly, with the foregoing in mind it is a primary object of the present invention to provide an immersion washer apparatus for use in cleaning various articles during maintenance, repair and rebuilding operations, and particularly articles having blind holes and crevices, wherein the apparatus includes means for recovering and recycling of aqueous cleaning solution used therein, removing contaminants therefrom and providing on-site disposal means for disposing of the contaminants and refuse.

It is another object of the present invention to provide an immersion washer apparatus, as described above, which provides a practical and economical means of complying with Environment Protection Agency contaminate disposal guidelines.

It is a further object of the present invention to provide an immersion washer apparatus providing means for regularly and constantly removing contaminants from the cleaning solution during operation thereof, and further providing self-contained means for disposal of contaminants and refuse in a manner which complies which EPA disposal guidelines.

It is still a further object of the present invention to provide an immersion washer apparatus which eliminates the need to regularly dispose of large volumes of contaminated cleaning solution.

It is yet another object of the present invention to provide an immersion washer apparatus which is relatively inexpensive and requires minimal maintenance.

It is still a further object of the present invention to provide an immersion washer apparatus which complies with all government imposed safety requirements.

It is still a further object of the present invention to provide an immersion washer apparatus which employs several means of removing and disposing of contaminants during normal operation thereof.

These and other objects and advantages of the present invention will be more readily apparent in the description which follows.

BRIEF DESCRIPTION OF THE DRAWINGS

For a fuller understanding of the nature of the present invention, reference should be had to the following detailed description taken in connection with the accompanying drawings in which:

FIG. 1 is a front, top perspective view of the immersion washer apparatus of the present invention;

FIG. 5 is an isolated view, shown in perspective, of an oxidation chamber and cleaning solution purification assembly of the washer apparatus of the present invention.

Like reference numerals refer to like parts throughout the several views of the drawings.

DETAILED DESCRIPTION OF THE PREFERRED EMBODIMENT

Figure 2:
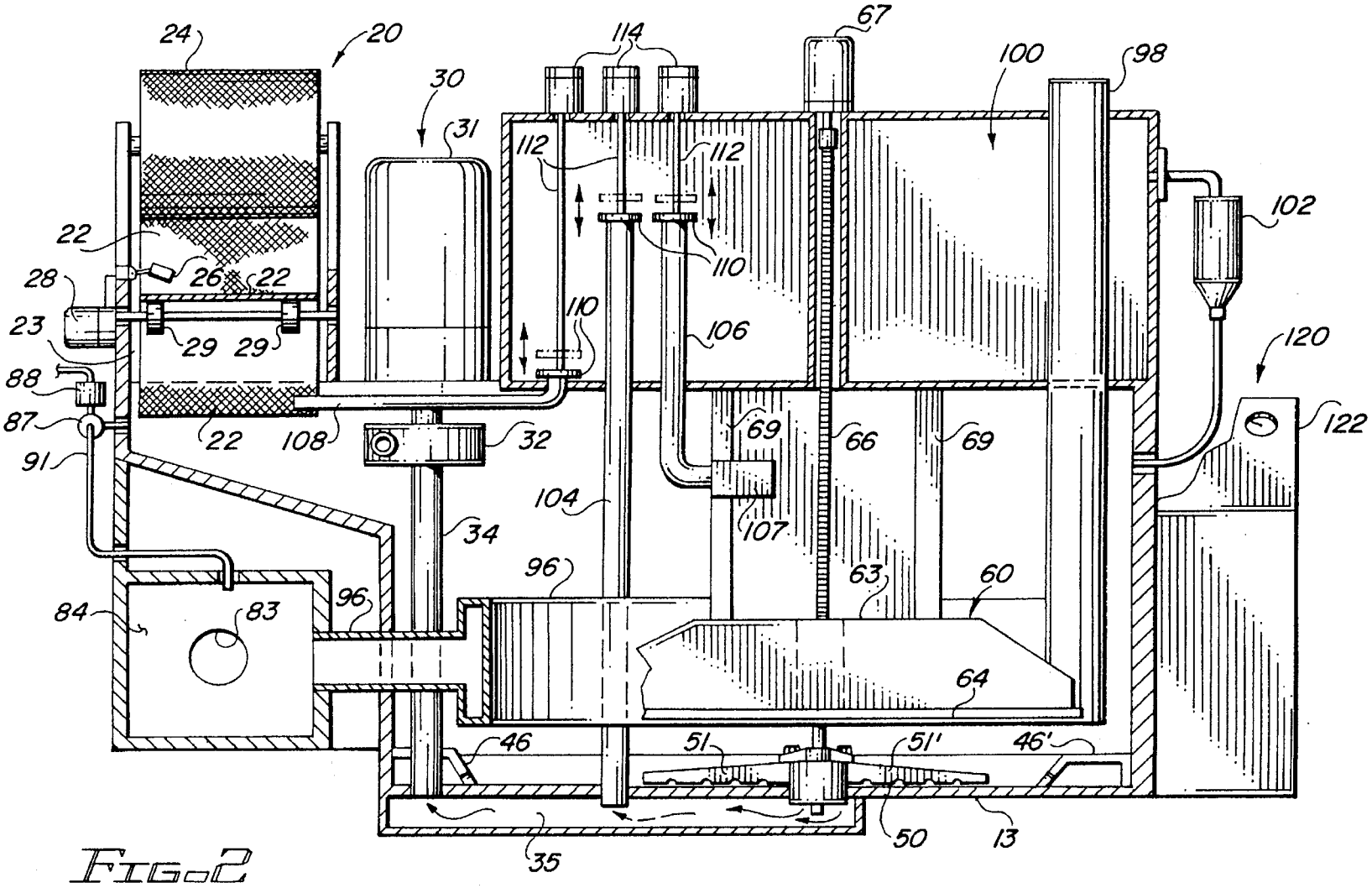
FIG. 2 is a front elevation, in partial section, of the immersion washer apparatus.

Referring to the several views of the drawings and initially FIGS. 1 and 2, there is generally illustrated the immersion washer apparatus 10 of the present invention. The apparatus 10 includes a primary cleaning chamber 12 surrounded by front, rear and opposite side walls and a bottom floor 13. The primary cleaning chamber 12 may further include a lid 14 for covering an open top thereof. The cleaning chamber 12 is specifically sized and configured to contain a predetermined quantity of cleaning solution, preferably an aqueous cleaning solution, for immersing articles to be cleaned therein.

A filter means 20 is provided for removing contaminants from the cleaning solution and includes a filtration sheet 22 which is pulled from a supply source 24, such as a roll. The filtration sheet extends from the supply source 24 across a drainage trough 23, wherein cleaning solution deposited on the filtration sheet is caused to be transferred through the filtration sheet 22 and removing contaminants in the process. A fluid level sensor 26 in the drainage trough 23 senses when the cleaning solution in the trough 23 reaches a predetermined level due to saturation of the filtration sheet 22 with contaminants, and thus impeding passage of the cleaning solution through the filtration sheet. Upon sensing the cleaning solution reaching a predetermined level, the fluid level sensor 26 activates a roller motor 28 causing rollers 29 to be rotated and thus pulling the filtration sheet 22 from the supply source 24 so that the saturated portion of the filtration sheet is removed from the trough 23 and a clean section of filtration sheet is positioned in the trough 23.

Figure 4:
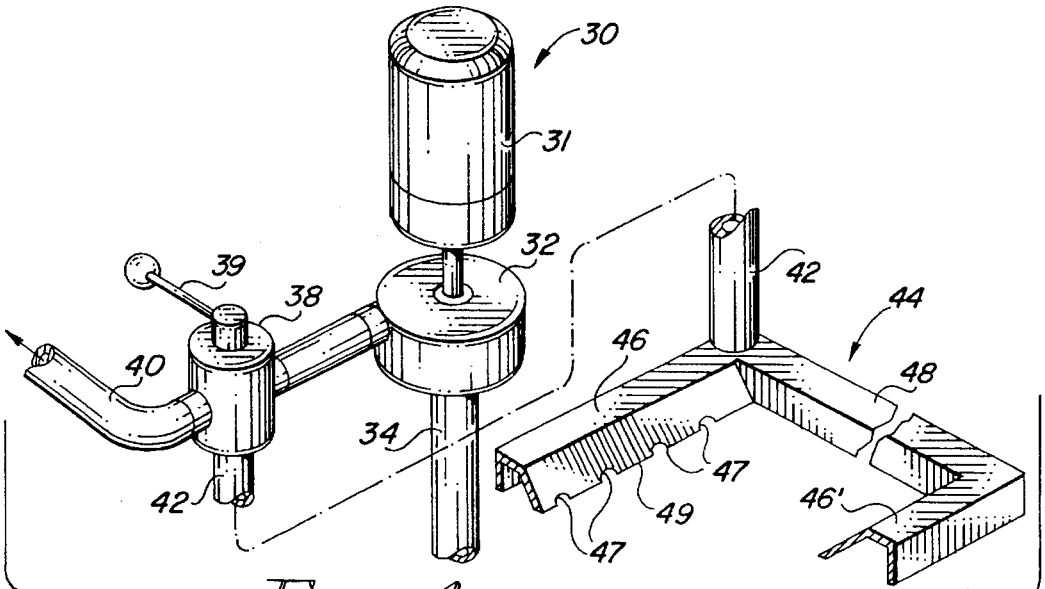
FIG. 4 is a partially exploded and isolated view, shown in perspective, of a pump and bottom wash system of the present invention.

Referring to FIGS. 1, 2 and 4, there is illustrated pump means 30 for transferring the cleaning solution from the primary cleaning chamber to the drainage trough 23 for discharge on the filtration sheet 22. Once having passed through the filtration sheet 22, the cleaning solution returns to the primary cleaning chamber 12. In accordance with a preferred embodiment, the pump means 30 includes pump motor 31 and centrifugal pump 32. An intake line 34 extends from a lower channel 35, below the cleaning chamber bottom floor 13, in fluid flow communication therewith. An opposite end of the input line 34 leads to the intake of centrifugal pump 32. An output line 36 extends from an output of centrifugal pump 32 to a three-way valve 38. The three-way valve 38 is specifically structured to control direction of fluid flow from the output line 36 to either a filter delivery line 40 leading to the drainage trough 23 or, alternatively, to a bottom wash return line 42 leading to a bottom wash jet assembly 44 on the bottom floor 13 of the primary wash chamber 12. The bottom wash jet assembly 44 includes opposite jet wash channels 46, 46' positioned and disposed on opposite sides of the wash chamber floor 13 as best seen in FIG. 2. Referring now to FIG. 4, the opposite jet wash channels 46, 46' are interconnected in fluid communication with one another and the return line 42 by a channel 48. The opposite jet wash channels 46, 46' include openings 47 along an inboard lower edge 49, forming an opening between the lower inboard edge 49 and the bottom floor 13 for discharge of the cleaning solution across the bottom floor 13 of the wash chamber 12. Accordingly, operation of the three-way valve 38 by movement of level 39 serves to selectively direct flow of the cleaning solution from the pump 32 to either the filter means 20 or to the bottom jet wash assembly 44. This serves to wash the bottom floor 13 of accumulated sediment, forcing the bottom sediment (contaminants) into a central sweep zone defined by a circumferential area through which a bottom sweep arm 50 rotates. The bottom sweep arm 50 is disposed in fluid flow communication with the lower channel 35 and, preferably includes opposite arm portions 51, 51'. Each of the arm portions 51, 51' includes fluid intake means (such as apertures) on a lower portion thereof for intake of the cleaning solution and bottom sediment therethrough for subsequent transfer through the bottom channel 35, and to intake line 34, when the pump means 30 is activated, as illustrated by the arrows in FIG. 2.

Figure 3:
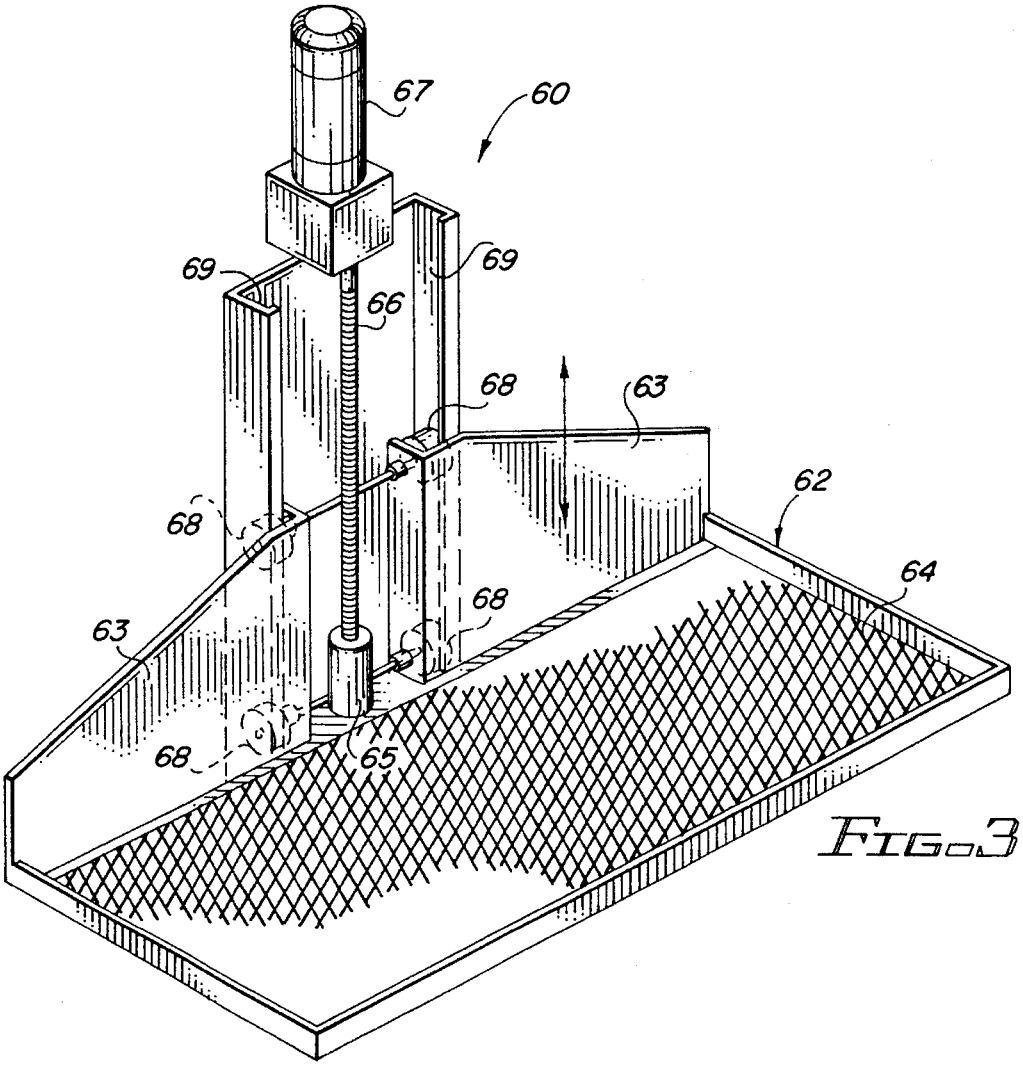
FIG. 3 is an isolated view, shown in perspective, of an article support assembly of the present invention.

With reference to FIGS. 2 and 3, there is generally illustrated article support means 60 for supporting articles to be cleaned in the primary cleaning chamber 12. The article support means 60 includes a platform 62 having a back plate 63 and support base 64 preferably comprised of a metal grate. The support base 64 is specifically positioned and disposed to support the articles to be cleaned thereon, the platform 62 being sized and configured to be lowered down into an interior of the primary cleaning chamber 12, so that the articles can by completely immersed in the cleaning solution. To facilitate raising and lowering of the platform 62, a lead screw 66 extends vertically from a motor 67 above the cleaning chamber 12 and terminating at or near the bottom floor 13. A ball screw or like coupling 65 is movably engaged on the lead screw 66, such that upon selective rotation of the lead screw 66, clockwise or counterclockwise, by motor 67, the ball screw coupling 65 is caused to be moved up and down along the length of the lead screw 66. The ball screw coupling 65 is attached to a back of the plate 63 of the platform 62, so that upon rotation of lead screw 66 the platform 62 is caused to be selectively raised or lowered within the cleaning chamber 12. Guide rollers 68 attached to the back plate 63 ride within a guide channel 69 to stabilize vertical movement of the platform 62 during raising and lowering.

The platform 62, and articles supported thereon, can be agitated by various means in order to cause movement of the cleaning solution relative to surfaces and crevices of the articles, thereby promoting washing by loosening and/or removing contaminants therefrom. In a preferred embodiment, the platform 62 is agitated by quick start and stopping of the motor 67, causing the platform to be raised and then lowered a short distance near a lower portion of the cleaning chamber 12.

Heating means 80 are provided for supplying heat to a thermal oxidation chamber 84 at temperatures preferably in excess of 1,500 degrees fahrenheit. In a preferred embodiment, the heating means 80 includes a fan forced electronic heater 82 interconnected to an open port 83 leading to the thermal oxidation chamber 84, whereupon heat is force fed therein, as indicated by the arrows in FIG. 5. Other heat generating means, such as a gas heater, could be used. The thermal oxidation chamber 84 is specifically sized and configured to receive refuse, including contaminated filtration sheets from the filter means 20 therein. A tray for holding the filtration sheets and other refuse can be used in order to promote thermal oxidation by heat convection, whereupon the refuse disintegrates slowly at high temperatures emitting close to zero harmful emissions. A cleaning solution burn-off assembly 86 includes a valve 87 controlled by solenoid 88. A fluid transfer line 89 extends from the cleaning chamber 12 to the valve 87, which is normally closed when the burner 82 is not operating. Upon operation of the burner 82 for a predetermined period of time, a heat sensor 90 attached to the burner 82 senses that the heater 82 is operating and triggers the solenoid 88 which opens the valve 87. When the valve 87 is open, cleaning solution, containing contaminants, is released through the delivery line 91 leading to the interior of the thermal oxidation chamber 84. An orifice 92 can be provided in the delivery line 91 to achieve a controlled release of cleaning solution into the thermal oxidation chamber 84. As the cleaning solution is deposited in the thermal oxidation chamber 84, the high temperatures cause the liquid to immediately vaporize, whereupon metal deposits and other contaminant solids are deposited in a tray 93 in the thermal oxidation chamber 84. Thus, an additional means of removing contaminants from the cleaning solution and disposing of the contaminants in a environmentally sound manner is provided. Between the filter means 20 and the cleaning solution burnoff assembly 86, a substantial amount of contaminants are regularly removed and disposed of during normal operation. Water, cleaning detergents and various coagulant agents would be added as needed to maintain predetermined control standards and fluid level in the cleaning chamber 12.

Referring to FIG. 2, there is shown a heat transfer duct 96 which interconnects with the thermal oxidation chamber 84 to receive hot flue gases generated therein during thermal oxidation or from just the continuous operation of heater 82. The heat transfer duct 96 passes through the cleaning chamber 12 interior, along a side and the back thereof, and interconnecting with a flue gas exhaust stack 98 through which flue gases are exhausted to atmosphere. Heat from the hot flue gases passing through the duct 96 is transferred to the cleaning solution surrounding the portion of the duct 96 within the cleaning chamber 12.

In order to remove coagulants and flocculants from the cleaning solution in the cleaning chamber 12, while preventing breakup of the charges in the coagulant/flocculant agents, a vacuum chamber 100 is provided to draw both surface coagulants/flocculants as well a bottom coagulants/flocculants from the cleaning chamber 12 in a non-turbulent manner. To achieve negative pressure in the vacuum chamber 100, a vacuum pump 102 is used, interconnecting to the chamber 100 and structured to draw air therefrom. A bottom suction conduit 104 includes an upper end located within the interior of the vacuum chamber 100 and an opposite lower end disposed in fluid communication within the channel 35 below the cleaning chamber 12. A second upper level suction conduit 106 includes an upper end within the interior of the vacuum chamber and a lower end within the upper interior portion of the cleaning chamber 12. A filter 107 may be provided on the lower end of the conduit 106 to prevent intake of large particles. A delivery conduit 108 has a first end disposed at a lower portion of the vacuum chamber 100 interior and an opposite end leading to the drainage trough 23. The upper ends of each of the respective conduits 104, 106, 108 (within the vacuum chamber 100) are normally closed by individual valve members 110 disposed in blocking engagement on the open top ends of the conduit 104, 106 and 108. The valve members 110 are each independently interconnected with respective linkages 112 leading to corresponding actuators 114 on a top of the vacuum chamber 100. The actuators 114 are each structured to move the respective linkage 112, on demand, to raise and lower the respective valve member 110 into and out of blocking engagement on the open end of the conduits 104, 106 and 108. In this manner, with a negative pressure in the vacuum chamber 100 creating a suction, release of the valve members 110 on the bottom and upper level suction conduits 104, 106 will serve to selectively draw cleaning solution and coagulants/flocculants from either the bottom or surface of the cleaning solution in the cleaning chamber 12. Upon returning to atmospheric pressure in the vacuum chamber 100, the collected cleaning solution and coagulants/flocculants therein can be released through the delivery conduit 108 by raising the respective valve member 110 on the open end thereof. The collected cleaning solution and coagulants are thereafter lead through the delivery conduit 108 and deposited on the filtration sheet 22.

Control means 120 are provided on a control console 122 for facilitating selective control of the movement of the platform between the raised and lowered positions, as well as agitation of the platform. Further, the control means 120 facilitates control of the vacuum chamber 100, including selective control of each of the actuators 114 and the vacuum pump 102. Finally, the control means 120 enables actuation of the pump means 30 and heater 82 during normal start-up operation.

While the invention has been shown and described in what is considered to be a pratical and preferred embodiment, it is recognized that departures may be made within the spirit and scope of the following claims which, therefore, should not be limited except within the Doctrine of Equivalents.

Now that the invention has been described,

What is claimed is:

1. An apparatus for soaking and cleaning articles in a cleaning solution comprising:

a primary cleaning chamber sized and configured to contain a predetermined charge of the cleaning solution for immersing the articles therein, filter means for removing contaminants from the cleaning solution and including a filtration sheet pulled from a roll on a roller assembly across a drainage trough, fluid level sensor means in said drainage trough for actuating movement of said filtration sheet to provide a clean section of said filtration sheet in said trough upon the cleaning solution reaching a predetermined level in said trough due to saturation of said filtration sheet with contaminants, roller means triggered by said fluid level sensor for pulling said filtration sheet from said roll to provide said clean section of said filtration sheet, heating means for heating said cleaning solution and including a fan forced electronic burner structured and disposed to generate hot flue gasses, said heating means further including a heat transfer duct in fluid air-flow communication with said fan forced electronic burner and an exhaust flue stack and structured for passage of the hot flue gasses therethrough, said heat transferred duct being exposed to said cleaning solution in said primary cleaning chamber for transferring heat from the hot flue gasses passing therethrough to said cleaning solution, a thermal oxidation chamber communicating with said fan forced electronic burner and said heat transferred duct and being structured and disposed to receive refuse and contaminants therein for disposal by thermal oxidation, pump means for transferring the cleaning solution from the primary cleaning chamber to said drainage trough for passage through said filtration sheet and including a sweep arm on a bottom of said primary cleaning chamber and a pump in fluid flow communication with said sweep arm, said pump being structured and disposed to draw the cleaning solution and contaminants settled on the cleaning chamber bottom through said sweep arm for delivery to said filter means, article support means including a platform for supporting the articles to be cleaned thereon, and means for lowering and raising said platform and the articles supported thereon into and out of the primary cleaning chamber for selectively immersing and removing the articles from within the cleaning solution, vacuum means for drawing the cleaning solution from said primary cleaning chamber and including a vacuum chamber having means for creating a vacuum therein and further including a bottom suction conduit for selectively drawing the cleaning solution from the bottom of the cleaning chamber into the vacuum chamber and an upper level suction conduit for selectively drawing the cleaning solution from an upper portion of the primary cleaning chamber into the vacuum chamber, the cleaning solution being drawn through the conduits by a suction force created by the vacuum in said vacuum chamber, and a delivery conduit for selectively delivering the cleaning solution to said filter means, agitation means for agitating said platform and the articles supported thereon when immersed in the cleaning solution, creating movement of the cleaning solution relative to surfaces of the articles, resulting in loosening and removal of at least some contaminants therefrom and thereby promoting cleaning of the articles, and control means for selectively controlling movement of said platform and said agitation means and further for controlling said vacuum creating means, said pump means and the selective drawing and transfer of the cleaning solution through said bottom suction conduit, said upper level suction conduit or said delivery conduit.

2. An apparatus as set forth in claim 1 further including a bottom wash system for moving contaminants on the bottom of said cleaning chamber into a sweep zone, defined by a circumferential area through which said sweep arm rotates, so that the contaminants are drawn through said sweep arm for delivery to said filter means, said bottom wash system including jet means near the bottom of said cleaning chamber and structured to direct a flow of the cleaning solution therefrom towards said sweep zone.

3. An apparatus as set forth in claim 2 wherein said bottom wash system further includes a 3-way valve structured and disposed to selectively direct a discharge of the cleaning solution therefrom to either said filter means or said jet means.

4. An apparatus as set forth in claim 1 further including a cleaning solution burn-off system for removing contaminants from said cleaning solution and including a fluid transfer line extending from said cleaning chamber to a valve and further including a delivery line extending from said valve to said thermal oxidation chamber, whereupon opening of said valve results in delivery of the cleaning solution, at a predetermined flow rate, to said thermal oxidation chamber for vaporization and separating of contaminants therefrom.

5. An apparatus for soaking cleaning articles in a cleaning solution comprising:

a primary cleaning chamber sized and configured to contain a predetermined charge of the cleaning solution for immersing the articles therein, filter means for removing contaminants from the cleaning solution and including a filtration sheet pulled from a supply source across a drainage trough, fluid level sensor means in said drainage trough for actuating movement of said filtration sheet to provide a clean section of said filtration sheet in said trough upon the cleaning solution reaching a predetermined level in said trough due to saturation of said filtration sheet with contaminants, heating means for heating said cleaning solution and including a burner structured and disposed to generate hot flue gasses, said heating means further including a heat transfer duct in fluid air-flow communication with said burner and an exhaust flue stack and structured for passage of the hot flue gasses therethrough, said heat transfer duct being exposed to said cleaning solution in said primary cleaning chamber for heating the cleaning solution by transfer of heat thereto from the hot flue gasses passing through said heat transfer duct, a thermal oxidation chamber disposed in fluid communication with said burner and said heat transfer duct and being structured and disposed to receive refuse and contaminants therein for disposal by thermal oxidation, pump means for transferring the cleaning solution from said primary cleaning chamber to said drainage trough for passage through said filtration sheet and including a sweep arm on a bottom of said primary cleaning chamber and a pump in fluid communication with said sweep arm said pump being structured and disposed to draw the cleaning solution and contaminants settled on the cleaning chamber bottom through said sweep arm for delivery to said filter means and passage through said filtration sheet, a bottom wash system for moving contaminants on the bottom of said cleaning chamber into a sweep zone, defined by a circumferential area through which said sweep arm rotates, so that contaminants are drawn through said sweep arm for delivery to said filter means, said bottom wash system including jet means positioned and disposed near the bottom of the cleaning chamber and structured to direct a flow of the cleaning solution towards said sweep zone, a three-way valve structured and disposed to selectively direct a discharge of the cleaning solution therefrom to either said filter means or said jet means, a cleaning solution burn-off means for removing contaminants from said cleaning solution and including a fluid transfer line extending from said cleaning chamber to a valve and further including a delivery line extending from said valve to said thermal oxidation chamber, whereupon opening of said valve results in delivery of the cleaning solution, at a predetermined flow rate, to said thermal oxidation chamber for vaporization and separation of contaminants therefrom, article support means including a platform for supporting the articles to be cleaned thereon, and means for lowering and raising said platform and the articles supported thereon into and out of the primary cleaning chamber for selectively immersing and removing the articles from within the cleaning solution, agitation means for agitating said platform and the articles supported thereon when immersed in the cleaning solution, creating movement of the cleaning solution relative to surfaces of the articles, resulting in at least partial loosening and removal of contaminants therefrom and thereby promoting cleaning of the articles, and control means for selectively controlling movement of said platform and said agitation means, and further for controlling actuation of said pump means.

6. An apparatus for soaking and cleaning articles in a cleaning solution comprising:

a primary cleaning chamber sized and configured to contain a predetermined charge of the cleaning solution for immersing the articles therein, filter means for removing contaminants from said cleaning solution, heating means for heating the cleaning solution to a predetermined temperature, pump means for circulating the cleaning solution from said primary cleaning chamber to said filter means for passage of said cleaning solution therethrough, sweep means on a bottom of said primary cleaning chamber in fluid communication with said pump means, said sweep means including a sweep arm structured and disposed to move through a circumferential area defining a sweep zone and to draw the cleaning solution and contaminants within said sweep zone therethrough for delivery to said filter means, jet means positioned and disposed near the bottom of said primary cleaning chamber and being structured and disposed to direct a flow of the cleaning solution therefrom towards said sweep zone, causing contaminants on the bottom of said primary cleaning chamber to be moved into said sweep zone for suction through said sweep arm, article support means including a platform for supporting the articles to be cleaned thereon, means for lowering and raising said platform and the articles into and out of the primary cleaning chamber for selectively immersing and removing the articles from within the cleaning solution, and control means for activating said pump means and said article support means to selectively control raising and lowering of said platform within said primary cleaning chamber.

7. An apparatus as set forth in claim 6 further including agitation means for agitating said platform and the articles supported thereon when immersed in the cleaning solution, creating movement of the cleaning solution relative to surfaces of the articles, resulting in at least partial loosening and removal of contaminants therefrom and thereby promoting cleaning of the articles.

8. An apparatus as set forth in claim 6 further including a thermal oxidation chamber being structured and disposed to receive refuse and contaminants therein for disposal by thermal oxidation.

9. An apparatus as set forth in claim 8 further including cleaning solution burn-off means for removing contaminants from said cleaning solution and including a fluid transfer line extending from said cleaning chamber to a valve and further including a delivery line extending from said valve to said thermal oxidation chamber, whereupon opening of said valve results in delivery of the cleaning solution, at a predetermined flow rate, to said thermal oxidation chamber for vaporization and separating of contaminants therefrom.

10. An apparatus as set forth in claim 9 wherein said filter means includes a filtration sheet pulled from a supply source across a drainage trough.

11. An apparatus as set forth in claim 10 further including fluid level sensor means in said drainage trough for actuating movement of said filtration sheet to provide a clean section of said filtration sheet in said trough upon the cleaning solution reaching a predetermined level in said trough due to saturation of said filtration sheet with contaminants.

12. An apparatus as set forth in claim 10 wherein said heating means includes a burner structured and disposed to generate hot flue gasses, said heating means further including a heat transfer duct in fluid air-flow communication with said burner and an exhaust flue stack, said heat transfer duct being structured for passage of hot flue gasses therethrough and being exposed to said cleaning solution in said primary cleaning chamber in heat transferring relation therewith for heating the cleaning solution by transfer of heat thereto from the hot flue gasses passing through said heat transfer duct.

* * * * *